United States Patent [19]

Butts

[11] 3,963,194

[45] June 15, 1976

[54] DISPENSER FOR COILED ELONGATED FLEXIBLE PRODUCT

[75] Inventor: Charles C. Butts, Hacienda Heights, Calif.

[73] Assignee: Davis Walker Corporation, Los Angeles, Calif.

[22] Filed: June 20, 1974

[21] Appl. No.: 481,144

[52] U.S. Cl. ..... 242/129

[51] Int. Cl.[2] ..... B65H 49/00

[58] Field of Search..... 242/129, 128; 211/49 R, 211/49 D, 59

[56] References Cited

UNITED STATES PATENTS 2,673,046 3/1954 Lewis ..... 242/128

2,916,152 12/1959 Dull ..... 211/49

*Primary Examiner*—Leonard D. Christian

*Attorney, Agent, or Firm*—Christie, Parker & Hale

[57] ABSTRACT

Wire, cable, rope, and the like, in the form of an annular coil is stored on a vertical hollow spindle which rests on a base that has downwardly extending legs. The spindle and annular coil are disposed over an opening in the base so that one end of the wire or other material can be pulled from the upper end of the coil, down through the spindle and opening in the base, and out from under the base. An upwardly converging cap on the upper end of the spindle prevents adjacent turns of the material from tangling when the material is pulled from the coil.

10 Claims, 2 Drawing Figures

66
62
64
46
50
40
31
52
48
44
42
24
10
34
11
36
60
56
30
26
28
72
12
25
18
17
21
20
22
32
70
16
14
76
78

DISPENSER FOR COILED ELONGATED FLEXIBLE PRODUCT

BACKGROUND OF THE INVENTION

1. Field of the Invention

This invention relates to apparatus for dispensing elongated flexible products, such as, wire, cable, rope, and the like, from an annular coil of the material mounted on an upright spindle.

2. Description of the Prior Art

U.S. Pat. No. 3,127,018 discloses a spindle or carrier for annular coils of elongated material, such as wire, rope, and the like. The prior art carriers are satisfactory for storing and transporting the coiled material. However, to remove the material from the carrier, it has in the past been necessary either to rotate the carrier as the material is removed, or else remove the coil and place it on a rotatable reel which turns as material is removed. Equipment to rotate the coil of material is expensive and difficult to control, particularly when a large mass of wire or the like forms the coil. The rotatable equipment is especially subject to rapid wear when the coil must be rotated intermittently but at relatively high speed, such as in the production line manufacture of springs from steel wire.

SUMMARY OF THE INVENTION

This invention provides apparatus which makes it possible to remove wire and the like rapidly from an annular coil without having to revolve the coil as the wire is removed. Thus, the only inertia involved in the removing operation is the mass of the discreet portion of wire actually being taken from the coil. This is but a small fraction of the total mass of the coiled material, making rapid and accurate changes in speed of the removed material possible with inexpensive and long-wearing equipment.

Briefly, the apparatus includes a base which has a vertical opening through it. Downwardly extending legs on the base support the base above a work surface on which the apparatus is disposed. An upright hollow spindle is mounted on the base and over the opening through the base. The spindle is shaped to fit within an annular coil of elongated flexible material so that one end of the material can be pulled from the upper end of the coil, down through the spindle and opening in the base, and out from under the base.

Preferably, the apparatus includes an upwardly converging cap mounted on the upper end of the spindle to prevent adjacent turns of the coiled material from tangling.

The preferred form of the apparatus also includes outwardly extending feet on the spindle and resting on the base. Means are provided for securing the feet to the base. An elongated roller is mounted under the base and adjacent the opening in the base. The roller is substantially horizontal and extends transversely with respect to the direction of wire leaving the base so that wire is pulled across the roller adjacent the base opening. Preferably, a second roller parallel to and laterally spaced from the first in the direction of movement of the material from the base is mounted adjacent the edge of the base to prevent wear as material is removed.

When two or more units of the apparatus of this invention are mounted in tandem on the bed of a truck for dispensing wire in an agricultural field, the base of the unit at the rear end of the truck bed includes a third roller adjacent the edge near the other unit of apparatus so that wire or the like drawn from the other unit can pass under the base of the rearmost unit and move across the rollers with a minimum amount of wear.

DESCRIPTION OF THE PREFERRED EMBODIMENTS

Figures 1, 2:
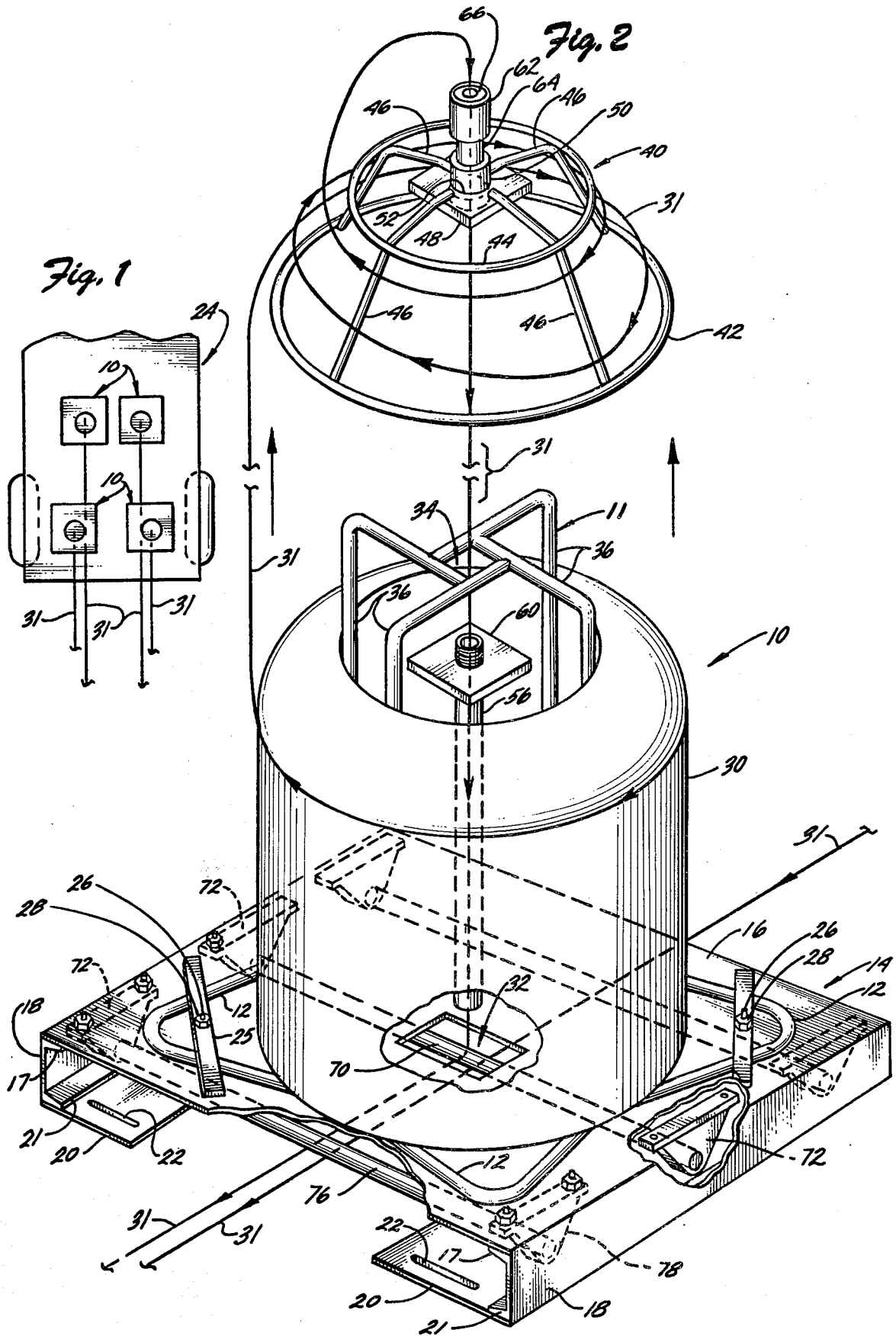
FIG. 1 is a fragmentary schematic plan view of four of the dispensers of this invention mounted on the bed of a truck for dispensing wire in an agricultural field.
FIG. 2 is an exploded perspective view, partly broken away, of the presently preferred dispenser of this invention.

Referring to FIG. 1, a dispenser 10 includes a vertical spindle 11 (of the type shown in U.S. Pat. No. 3,127,018) with four (only three are shown in FIG. 1) outwardly extending horizontal feet 12, which rest on a base 14, which includes a rectangular horizontal top 16 welded at opposite side edges to a top flange 17 of a respective channel beam 18 set on its side with the flanges extending inwardly. The channel beams serve as legs for the base and hold the base top spaced above the work surface on which the legs rest.

A separate respective elongated horizontal mounting plate 20 is welded to the bottom surface of a respective bottom flange 21 of the channel beams 18. A slot 22 through each of the mounting plates provides means for mounting the apparatus on the bed of a truck 24 shown in FIG. 2.

A pair of oppositely extending feet on the spindle are clamped to the top surface of the base by separate respective straps 25 and nuts 26 and bolts 28.

An annular coil 30 of wire 31 or other elongated flexible material, such as rope, cable, and the like, is disposed around the spindle and rests on the spindle feet over an opening 32 through the top of the base and lying directly under a square opening 34 at the upper end of the spindle where posts 36, which form the spindle, are welded together.

An upwardly converging cap 40 is adapted to fit over the upper end of the spindle. The cap includes a first or lower circular horizontal hoop 42 connected to a smaller second or upper circular horizontal hoop 44 by four equally spaced arms 46. The lower end of each arm is welded to the inner periphery of the bottom hoop, extends upwardly and inwardly where it is welded to the inner periphery of the upper hoop, and then turns substantially horizontally inwardly where the inner end of each arm is welded to a horizontal square crown plate 48 which has a vertical internally threaded lower coupling 50 welded through a central opening 52 in the crown plate.

When the dispenser is assembled for use, the crown plate rests on the upper end of the spindle so that the lower end of the lower coupling 50 extends into the square hole 34 of the spindle. The cap is held in place by a section of vertical pipe 56 collinear with the annular coil of material and threaded at its upper end into the lower end of the coupling 50. An outwardly extending crown flange 60 secured just below the upper end of the pipe 56 clamps against the bottom surfaces of the horizontal portions of the four posts which form the spindle. Thus, when the pipe is threaded snugly into the lower end of coupling 50, the cap is held securely on the upper end of the spindle.

Wire is removed from the annular coil by taking one end of the wire from the upper end of the coil, threading it down through an upper coupling 62 threaded onto the upper end of a vertical nipple 64 threaded at its lower end to the upper end of the lower coupling 50. An inner race 66 of a conventional ball bearing is press-fitted into the upper end of the upper coupling 62 to provide a long-wearing surface for wire passing down through the bearing race, upper coupling, nipple, lower coupling, and pipe.

Wire at the lower end of the pipe is pulled down through the base opening and around a horizontal transverse central roller 70 journaled at each end in a separate respective pillow block bearing 72 secured to the underside of the base top. The wire extends rearwardly, with respect to the truck shown in FIG. 2, across a transverse horizontal rear roller 76 secured at its respective ends in a separate respective pillow block bearing 78 mounted on the underside of the base top.

In using the apparatus shown in FIG. 1 to dispense wire in an agricultural field, say, a vineyard, four of the dispensers are mounted in two tandem pairs on the bed of the truck as shown in FIG. 2. Each of the dispensers is secured to the bed of the truck by bolts (not shown) extending through the slots 22 in the mounting plates 20 of the unit base (FIG. 1).

To put the dispensers into use, the caps are assembled as previously described and clamped firmly in place so that each lower hoop is at about the upper end of the coil or wire and approximately matches the diameter of the coiled wire before the dispensing operation begins. One end of the wire is taken from the upper end of each coil, and threaded down through the central portion of the cap and spindle, and out under the base and over the rear of the truck, as previously described. The wires are secured to a post or other suitable anchor in the field, and the truck is driven across the field between adjacent rows, causing the wires to be removed from each of their respective coils. There is no need to rotate the coil, and only that wire in the process of being removed has any motion relative to the remainder of the wire on the coil. Accordingly, it is easy to start and stop the dispensing of the wire quickly and without the need of any rotatable equipment.

With the apparatus just described, four or more wires can be quickly and easily laid in an agricultural field by driving the truck at the rate of 10 to 15 m.p.h. The wire from each forward unit passes across its respective central and forward rollers, and across the three rollers under the base of a respective rearward unit in the tandem. Thus, two or more wires can be passed simultaneously under the rearmost base. The cap on the upper end of the spindle prevents the wire from tangling, even though it is removed at a relatively rapid rate, and more than one turn of wire is disposed around the cap at one time.

A large supply of endless wire can be stored in the coil from which the wire is dispensed. Before this invention, it was the practice to use relatively short lengths of wire in separate relatively small coils, which rotated as the truck was driven across the field. At the end of each length of wire on each small coil, the truck had to be stopped, the new coil mounted on the rotatable equipment, and a splice made between the ends of the old coil and new coil of wire.

The invention is also useful in dispensing wire to make springs where relatively short sections of wire must be dispensed rapidly and intermittently. Before this invention, large rotatable supports, which had to accelerate and decelerate, carried the entire mass of the wire coiled around the spindle. If large coils were used, the equipment quickly wore out. If smaller coils of wire were used, labor costs were increased because of more frequent loading of coils on the rotatable equipment.

I claim:

1. Apparatus for dispensing an elongated flexible material, such as, wire, cable, rope and the like, from an annular coil of the material, the apparatus comprising a base having a vertical opening therethrough, an upright hollow spindle mounted on the base and over the opening through the base, the spindle being shaped to fit within the annular coil of material so that the top end of the material on the coil can be pulled from the coil, and means for guiding the material from the top of the coil down through the spindle and opening in the base, and out from under the base, the guiding means including an upwardly converging cap mounted on the upper end of the spindle and means for removably clamping the cap on the upper end of the spindle.

2. Apparatus according to claim 1 in which the spindle includes outwardly extending feet at its lower end, and means for securing the feet to the base.

3. Apparatus according to claim 1 which includes a roller mounted adjacent the lower portion of the opening in the base on which material can move as it is removed from the annular coil.

4. Apparatus according to claim 3 in which the guiding means additionally includes a second roller mounted on the base and spaced from the first-mentioned roller in the direction in which the elongated flexible material moves as it is taken from the annular coil.

5. Apparatus according to claim 4 which includes a third roller secured to the base and spaced from the first-mentioned roller in the direction opposite from that in which the elongated flexible material is removed from the annular coil to permit two or more lengths of elongated flexible material to pass under the base and across the rollers simultaneously.

6. Apparatus according to claim 1, in which the guiding means additionally includes a conduit extending downwardly from the cap through the spindle to the opening in the base to carry the material from the cap to a point under the base.

7. Apparatus according to claim 6, in which the conduit extends upwardly from the cap to form an upper surface across which the material passes as it moves from the cap to the conduit, the apparatus further including an inner race of a ballbearing disposed on the upper surface of the conduit to provide a long wearing surface.

8. Apparatus according to claim 7, in which the guiding means additionally includes a roller mounted adjacent to the lower portion of the opening in the base on which material can move as it is removed from the annular coil.

9. Apparatus according to claim 7, in which the spindle, the cap, and the conduit are stationary.

10. Apparatus according to claim 1, which includes downwardly extending legs on the base to support the base with a space thereunder.

* * * * *